US011091953B2

(12) United States Patent
van der Molen et al.

(10) Patent No.: US 11,091,953 B2
(45) Date of Patent: Aug. 17, 2021

(54) REVOLVING DOOR

(71) Applicant: Royal Boon Edam International B.V., Edam (NL)

(72) Inventors: Melvin Jarno van der Molen, Edam (NL); Gertjan Otto, Edam (NL); Gijsbert Henk Bakker, Edam (NL)

(73) Assignee: ROYAL BOON EDAM INTERNATIONAL B.V., Edam (NL)

( * ) Notice: Subject to any disclaimer, the term of this patent is extended or adjusted under 35 U.S.C. 154(b) by 29 days.

(21) Appl. No.: 16/677,371

(22) Filed: Nov. 7, 2019

(65) Prior Publication Data

US 2020/0071989 A1 Mar. 5, 2020

Related U.S. Application Data

(63) Continuation of application No. PCT/NL2018/050290, filed on May 3, 2018.

(30) Foreign Application Priority Data

May 8, 2017 (NL) ..... NL2018868

(51) Int. Cl.
*E05D 15/02* (2006.01)
*E06B 3/90* (2006.01)

(52) U.S. Cl.
CPC ..... *E06B 3/906* (2013.01)

(58) Field of Classification Search
CPC ..... E06B 3/906; E06B 3/40; E06B 3/4636; E06B 5/00; E06B 2003/404
USPC ..... 49/42, 44, 45
See application file for complete search history.

(56) References Cited

U.S. PATENT DOCUMENTS 798,786 A * 9/1905 Hansen ..... E06B 3/90 49/44
953,983 A * 4/1910 Zandt ..... 49/40
1,024,797 A * 4/1912 Maloosay ..... E06B 3/90 49/42
1,184,725 A 5/1916 Dawes
(Continued)

FOREIGN PATENT DOCUMENTS

DE 9208898 4/1993
DE 4211861 10/1993
(Continued)

*Primary Examiner* — Jerry E Redman
(74) *Attorney, Agent, or Firm* — Peacock Law P.C.; Justin Muehlmeyer

(57) ABSTRACT

A revolving door comprising an at least partly cylindrical shell wall, which is embodied with an entrance and an exit, and two rotatable door wings, which during normal operation are placed in each other's extended direction inside the shell wall, wherein between the shell wall and an end of at least one door wing, which end is movable near and along the shell wall, a sliding door is provided which is suitable for closing off the entrance or exit respectively, and in that during normal operation an end of the door wing is constantly positioned near the sliding door and between its lateral edges, and wherein the sliding door comprises two adjacent separable sliding door parts which in normal operation are connected to each other and are movable away from each other in an emergency situation to provide a free and unobstructed passage way through the entrance or exit respectively.

3 Claims, 3 Drawing Sheets

(56) References Cited

U.S. PATENT DOCUMENTS

| | | | | | |
|---|---|---|---|---|---|
| 1,273,463 | A * | 7/1918 | Dawes | 49/40 | |
| 1,417,372 | A * | 5/1922 | Friedland | E06B 3/90 | 49/42 |
| 1,516,719 | A * | 11/1924 | Alexander | E06B 3/90 | 49/45 |
| 2,081,774 | A | 5/1937 | Shields | | |
| 3,726,044 | A | 4/1973 | Economou | | |
| 4,341,165 | A | 7/1982 | Calandritti et al. | | |
| 4,557,073 | A * | 12/1985 | Sandling | E05D 15/02 | 109/8 |
| 4,843,761 | A * | 7/1989 | Sandling | E06B 3/90 | 49/41 |
| 5,542,211 | A * | 8/1996 | Colombo | E06B 3/906 | 49/42 |
| 5,634,295 | A * | 6/1997 | Bunzl | E06B 3/90 | 49/44 |
| 6,367,198 | B1 | 4/2002 | Rockenbach | | |
| 6,370,822 | B1 | 4/2002 | Otto | | |
| 7,104,008 | B2 * | 9/2006 | Yokotachi | E06B 3/90 | 49/40 |
| 10,837,225 | B2 * | 11/2020 | Lammes | E06B 3/90 | |
| 2002/0157315 | A1 * | 10/2002 | Nat | E06B 3/90 | 49/42 |
| 2004/0006919 | A1 * | 1/2004 | Wild | E06B 3/906 | 49/42 |
| 2009/0031632 | A1 | 2/2009 | Wang | | |
| 2009/0293362 | A1 * | 12/2009 | Wang | E05F 15/611 | 49/45 |
| 2010/0050525 | A1 * | 3/2010 | Blasi | E06B 3/90 | 49/26 |
| 2018/0371828 | A1 | 12/2018 | Lammes et al. | | |
| 2019/0063131 | A1 * | 2/2019 | Lammes | E06B 3/90 | |

FOREIGN PATENT DOCUMENTS

| | | |
|---|---|---|
| DE | 19905473 | 1/2001 |
| EP | 0296134 | 12/1988 |
| EP | 0606193 | 7/1994 |
| EP | 0715049 | 6/1996 |
| EP | 2236716 | 10/2010 |
| FR | 2373664 | 7/1978 |
| JP | 2007070437 | 3/2002 |
| JP | 2010001735 | 1/2010 |
| NL | 9302235 | 7/1995 |
| WO | 97/25509 | 7/1997 |
| WO | 02/10543 | 2/2002 |
| WO | 2017/150974 | 9/2017 |
| WO | 2017/188810 | 11/2017 |
| WO | 2018/208148 | 11/2018 |

* cited by examiner

REVOLVING DOOR

CROSS-REFERENCE TO RELATED APPLICATIONS

This application is a continuation of International Patent Application No. PCT/NL2018/050290, entitled "Revolving Door", filed on May 3, 2018, which claims priority to Netherlands Patent Application No. 2018868, entitled "Revolving Door", filed on May 8, 2017, and the specification and claims thereof are incorporated herein by reference.

BACKGROUND OF THE INVENTION

Embodiments of the present invention are directed to a revolving door comprising an at least partly cylindrical shell wall comprising an entrance and an exit, and two rotating door wings, which during normal operation are placed in each other's extended direction inside the shell wall. The ends of the door wings are preferably movable near and along the shell wall.

WO02/10543 discloses a revolving door wherein between the shell wall and an end of at least one door wing, a sliding door is provided which is suitable for closing off the entrance or exit respectively, and wherein during normal operation an end of the door wing is constantly positioned near the sliding door and between its lateral edges. In this way the sliding door is able to provide a draught preventing closure between the entrance and the exit, while the door wings pass the entrance and exit to maintain the traffic of persons between entrance and exit of the revolving door.

In order to meet legal requirements it is necessary to implement this known revolving door with an emergency exit provision, which is provided in this known revolving door by the feature that the two door wings can swivel towards each other with the central post or axis of the revolving door as a turning point.

JP 2010-001735 teaches a revolving door comprising an at least partly cylindrical shell wall, which is embodied with an entrance and an exit, and two rotatable door wings, which during normal operation are placed in each other's extended direction inside the shell wall, wherein between the shell wall and an end of at least one door wing, a sliding door is provided which is suitable for closing off the entrance or exit respectively, and wherein the sliding door comprises two adjacent separable sliding door parts. In this teaching each of the door wings is separable into an inner peripheral portion and an outer peripheral portion that may be separated from each other in case an obstruction occurs of the door wing. Furthermore during normal operation the outer peripheral portions of the door wings are connected with a hinge to the sliding doors.

BRIEF SUMMARY OF THE INVENTION

It is an object of the embodiments of the present invention to provide a revolving door in accordance with the preamble, with an emergency exit provision which does not require that the two door wings are swivelled towards each other with the central post or axis of the revolving door as a turning point.

To this end, the revolving door according to an embodiments of the present invention is preferably characterized in that the end of the at least one door wing is movable closely adjacent to and along the shell wall leaving sufficient room for the sliding door to move between the shell wall and the end of the at least one door wing, and that during normal operation the two adjacent separable sliding door parts of the sliding door are connected to each other, whereas simultaneously during normal operation the end of the door wing is constantly positioned adjacent to the sliding door and between its lateral edges without being connected to the sliding door, and that said two adjacent separable sliding door parts are movable away from each other in an emergency situation to provide a free and unobstructed passage way through the entrance or exit, respectively.

The door of embodiment of the present invention has the advantage of a relatively simple design which is cost-efficient in its manufacture, and that the emergency provision is reliable and operative without the complexities and inertia disadvantages of the door of WO02/10543. The door of JP 2010-001735 does not even provide for an emergency situation.

The advantage of providing users of the revolving door with a quickly and reliably available emergency exit can be further promoted in an embodiment wherein each rotatable door wing preferably comprises slidable door wing parts that are slidable to be placed in at least two positions, a first position corresponding to normal operation wherein at least one of the edges of said door wing parts is adjacent to the sliding door and between its lateral edges, and wherein said door wing parts extend radially away from said sliding door towards a true or imaginary central vertical axis of the revolving door, and a second position corresponding to an emergency situation wherein said door wing parts are at least in part adjacent or next to each other and wherein said edges of said door wing parts are distant from said sliding door to provide a free and unobstructed passage way through the entrance or exit, respectively.

The revolving door of this latter embodiment of the present invention also makes possible to provide that in an emergency situation, the two adjacent separable sliding door parts are jointly and in a connected condition moved away from the entrance and exit concurrently while the slidable door wing parts are moved from the first position to the second position wherein said door wing parts are at least in part adjacent or next to each other and wherein said edges of said door wing parts are distant from said sliding door to provide a free and unobstructed passage way through the entrance or exit, respectively.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Identical parts in the figures carry the same reference numbers.

Figure 1B:
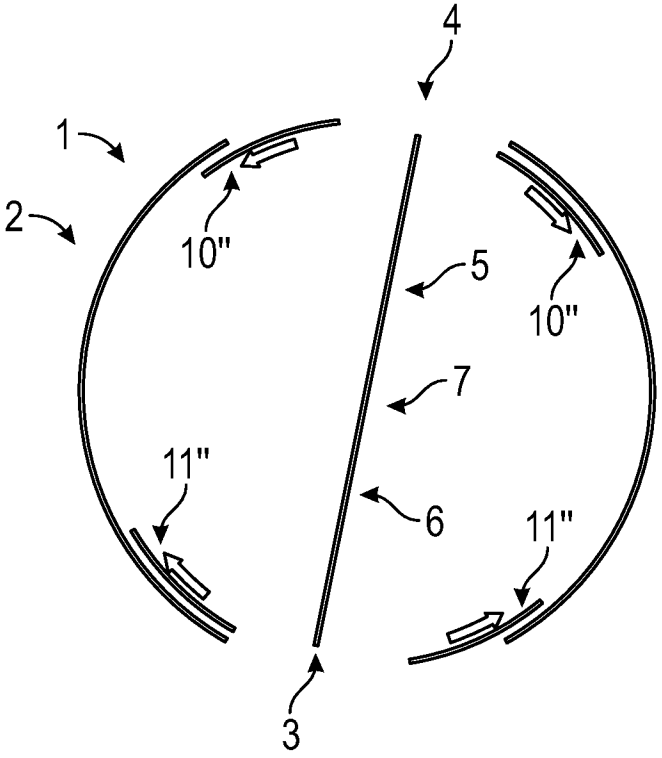
FIG. 1A and FIG. 1B illustrate a schematic top view of a first embodiment of the revolving door according to an embodiment of the present invention, FIG. 1A illustrating the door in a normal operational situation and FIG. 1B illustrating the door in an emergency situation.
Figure 1A:
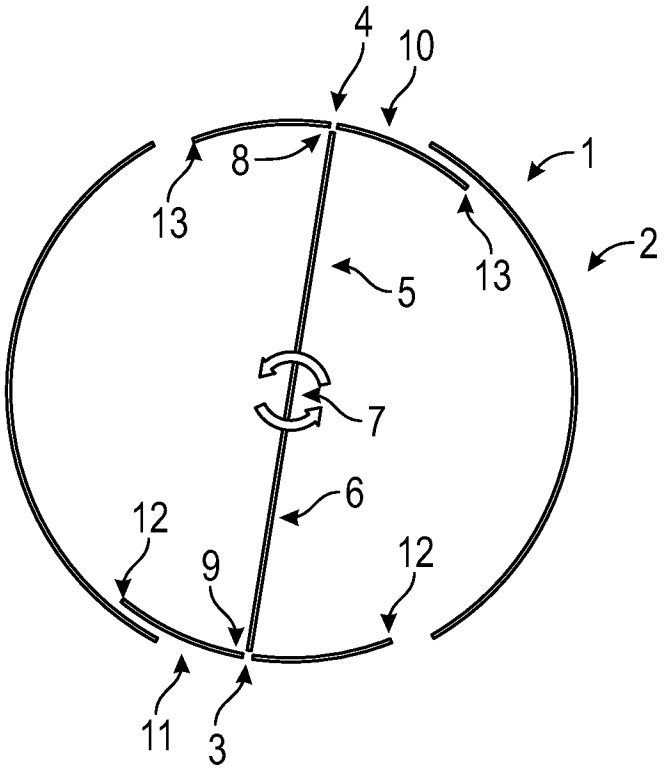
Figure 2B:
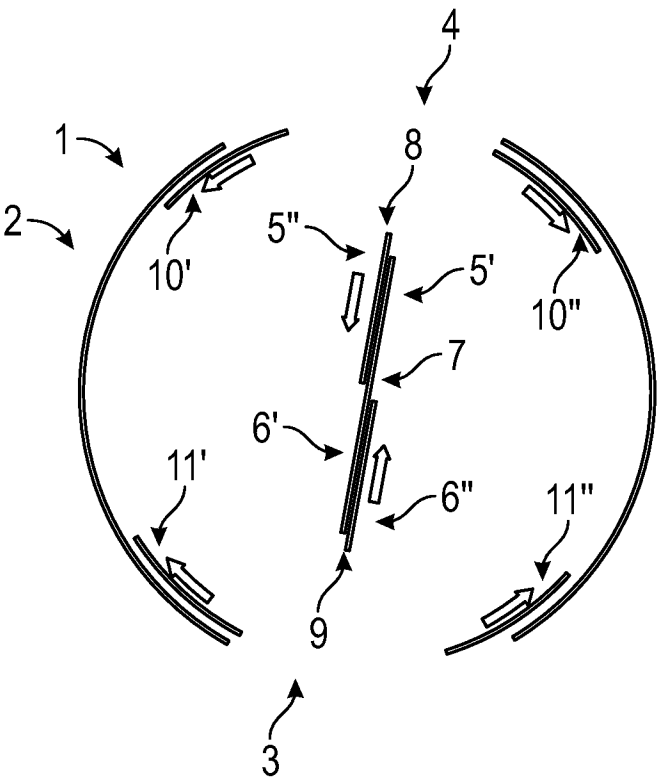
FIG. 2A and FIG. 2B illustrate a schematic top view of a second embodiment of the revolving door according to an embodiment of the present invention, FIG. 2A illustrating the door in a normal operational situation and FIG. 2B illustrating the door in a first emergency situation.
Figure 2A:
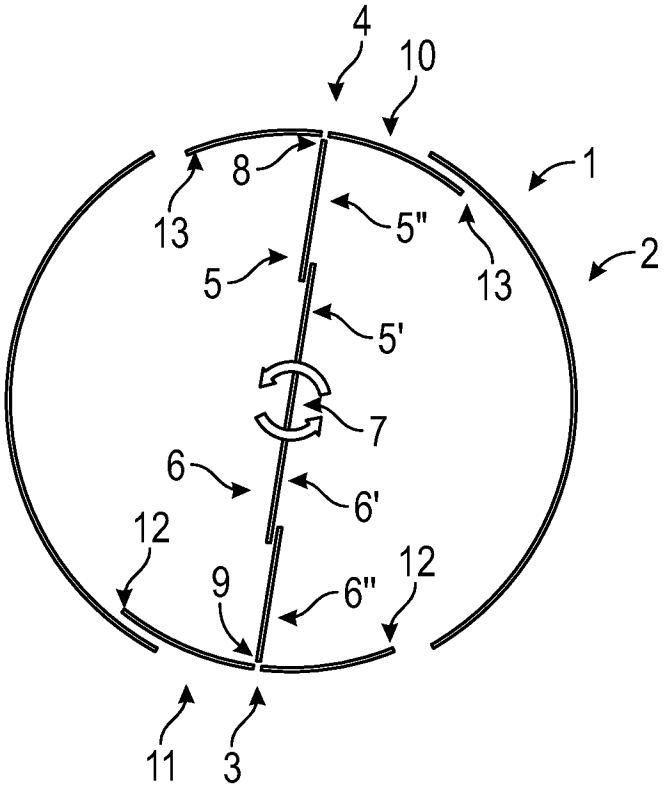
Figure 3B:
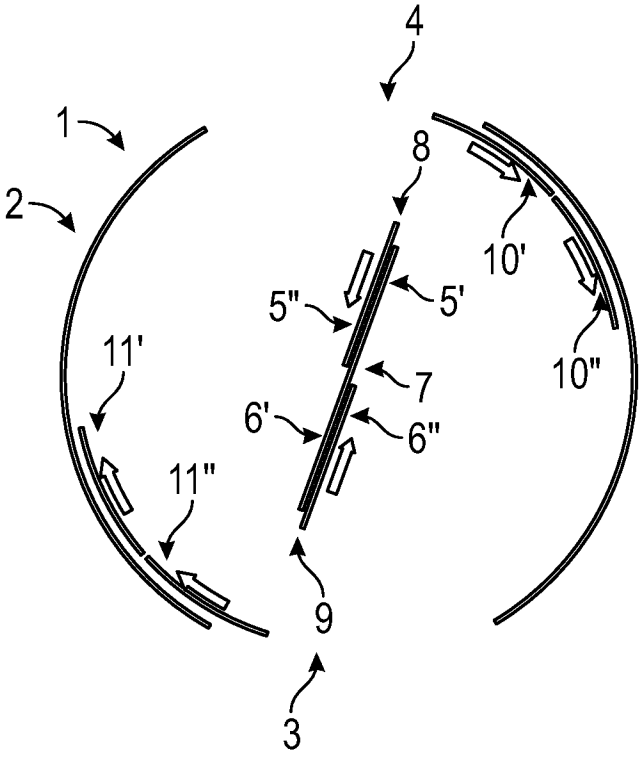
FIG. 3A and FIG. 3B illustrate a schematic top view of the second embodiment of the revolving door according to an embodiment of the present invention, FIG. 3A illustrating the door in a normal operational situation and FIG. 3B illustrating the door in a second way that answers to an emergency situation.
Figure 3A:
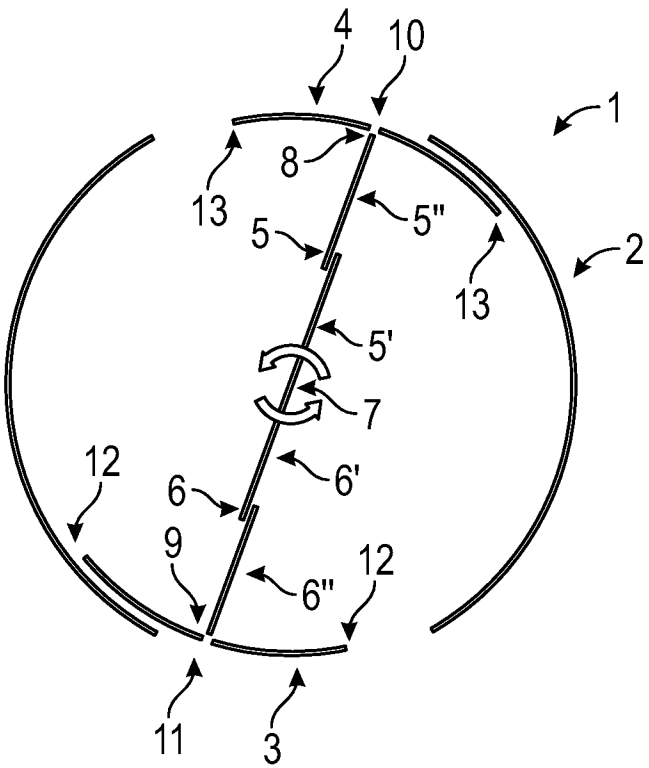

Referring now first to FIGS. 1A, 2A and 3A, different embodiments of the revolving door 1 of the invention are shown, which are preferably all embodied with an at least partly cylindrical shell wall 2, which is preferably provided with an entrance 3 and an exit 4. Such a revolving door 1 may be provided, for example, in the facade of a building or inside a building for the separation of different rooms that are in communication via the revolving door. Inside the shell wall 2, the revolving door 1 preferably further comprises two rotating door wings 5 and 6, which during normal operation are preferably placed in each other's extended direction. Normal operation as shown in FIGS. 1A, 2A and 3A entails that the door wings 5 and 6 in said position where the door wings 5 and 6 lie in each other's extended direction, are able to stand still or to rotate about a central column or axis 7. The column or axis 7 may be real or imaginary.

The revolving door 1 preferably further comprises a sliding door 10 and 11 which is provided between the shell wall 2 and an end 8 or 9, respectively, of at least one door wing 5 or 6, respectively. This sliding door 10 and 11 is dimensioned such that it is suitable to completely close off the entrance 3 or the exit 4, respectively. Preferably the end 8 and 9 of the door wing 5 and 6 is constantly near the sliding door 10 and 11 and between its lateral edges 12 and 13. In fact the end 8, 9 of the at least one door wing 5 and 6 is movable closely adjacent to and along the shell wall 2 leaving sufficient room for the sliding door 10 and 11 to move between the shell wall 2 and the end 8 and 9 of the at least one door wing 5 and 6. A first embodiment of the revolving door of the invention with these features is shown in FIG. 1A, a second embodiment is shown in FIG. 2A, and a third embodiment is shown in FIG. 3A, wherein said embodiments all have in common that the end 8 and 9 of the door wing 5 and 6, as shown in the figures, is normally located in a permanent position near the sliding door 10 and 11 and between its lateral edges 12 and 13 such that the door wings 5 and 6 and the sliding door 10 and 11 synchronously move or stand still. It is remarked though that the ends 8 and 9 of the door wings 5 and 6 are preferably not connected to the sliding doors 10 and 11. Anyway, when the door wings 5 and 6 are rotating, the situation will never arise that a free passage is formed between the entrance 3 and the exit 4 which is accompanied by draught. Draught is therefore effectively prevented.

To accommodate emergency situations in the prior art solution each of the door wings 5,6 as shown in FIG. 1A is foldably coupled with the rotatable central column 7, erected centrally inside the shell wall 2. Due to the door wings 5 and 6 being attached to the central column 7 their being folded away causes the ends 8 and 9 of the door wings 5 and 6 to move inward, so that they lose contact with the sliding doors 10 and 11. In the situation where the door wings 5 and 6 are completely folded away, a suitable emergency exit is created providing a roomy passage for large numbers of people that may be on foot or in a wheelchair. Reference is made to WO02/10543 which provides elucidating figures regarding this prior art solution.

As shown in FIG. 1B and FIG. 2B, embodiments of the present invention provide a sliding door 10 and 11 comprising two adjacent separable sliding door parts 10' and 11' and 10" and 11" which in normal operation are preferably connected to each other—as is depicted in FIG. 1A and FIG. 2A—and that are movable away from each other as shown in FIG. 1B and FIG. 2B to accommodate an emergency situation in order to provide a free and unobstructed passage way through the entrance 3 or exit 4, respectively.

FIG. 1A and FIG. 1B obviously relate to the standard situation that the two wing parts 5 and 6 can be fixed into each other's extended direction.

In FIG. 2A and FIG. 2B the situation is depicted that each rotatable door wing 5 and 6 comprises slidable door wing parts 5' and 5" and 6' and 6" that are slidable to be placed in at least two positions, a first position corresponding to normal operation wherein at least one of the edges 8 and 9 of said door wing parts 5' and 5" and 6' and 6" is adjacent to the sliding door 10 and 11 and between its lateral edges 12 and 13, and wherein said door wing parts 5' and 5" and 6' and 6" extend radially away from said sliding door 10 and 11 towards a true or imaginary central vertical axis 7 of the revolving door, and a second position corresponding to an emergency situation wherein said door wing parts 5' and 5" and 6' and 6" are at least in part adjacent or next to each other and wherein said edges 8 and 9 of said door wing parts 5' and 5" and 6' and 6" are distant from said sliding door 10 and 11 to provide a free and unobstructed passage way through the entrance 3 or exit 4, respectively.

The embodiment illustrated in FIGS. 2A and 2B is also more versatile in that it enables another type of operation to accommodate an emergency situation, which is depicted in FIGS. 3A and 3B. FIG. 3A is identical to FIG. 2A and relates to the normal operation of the sliding door according to this second embodiment. In FIG. 3B it is shown that it is also possible to accommodate an emergency situation in that the two adjacent separable sliding door parts 10 and 11 are jointly and in a connected condition moved away from the entrance 3 and exit 4 concurrently with the slidable door wing parts 5' and 5" and 6' and 6" being moved from the first position to the second position wherein said door wing parts 5' and 5" and 6' and 6" are at least in part adjacent or next to each other, and wherein said edges 8 and 9 of said door wing parts 5' and 5" and 6' and 6" are distant from said sliding door 10 and 11 to provide a free and unobstructed passage way through the entrance 3 or exit 4, respectively.

Although the invention has been discussed in the foregoing with reference to exemplary embodiments of the revolving door of the invention, the invention is not restricted to these particular embodiments which can be varied in many ways without departing from the invention. The discussed exemplary embodiments shall therefore not be used to construe the appended claims strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these exemplary embodiments. Note that in the specification and claims, "about" or "approximately" means within twenty percent (20%) of the numerical amount cited.

The invention claimed is:

1. A revolving door comprising:

an at least partly cylindrical shell wall comprising an entrance, an exit and two rotatable door wings, which during normal operation are disposed inside the at least partially cylindrical shell wall and oriented along or parallel with the diameter of the circle formed by the cylindrical shell wall of the revolving door, wherein between the at least partially cylindrical shell wall and an end of at least one of the two rotatable door wings, a sliding door is of a length adequate of extending at least partially across the entrance or the exit respectively, wherein the sliding door comprises two adjacent separable sliding door parts, wherein the two adjacent separable sliding door parts are movable away from each other in an emergency situation to provide a free and unobstructed passage way through the entrance or the exit, wherein the end of the at least one rotatable door wing is movable closely adjacent to and along the at least partially cylindrical shell wall leaving sufficient room for the sliding door to move between the at least partially cylindrical shell wall and the end of the at least one rotatable door wing, and that during normal operation the two adjacent separable sliding door parts of the sliding door are connected to each other, whereas simultaneously during normal operation the end of the at least one rotatable door wing is constantly positioned adjacent to the sliding door and between the lateral edges of the sliding door without being connected to the sliding door.

2. A revolving door according to claim 1, wherein each of the two rotatable door wings comprises slidable door wing parts that are slidable to be placed in at least two positions, a first position corresponding to normal operation wherein at least one of the edges of the slidable door wing parts is adjacent to the sliding door and between the lateral edges of the sliding door, and wherein the slidable door wing parts extend radially away from the sliding door towards a central vertical axis of the revolving door, and a second position corresponding to an emergency situation wherein the slidable door wing parts are at least in part adjacent or next to each other and wherein the edges of the door wing parts are distant from the sliding door to provide a free and unobstructed passage way through the entrance or the exit, respectively.

3. A revolving door according to claim 2, wherein the two adjacent separable sliding door parts are jointly and in a connected condition moved away from the entrance and exit concurrently with the slidable door wing parts being moved from the first position to the second position corresponding to an emergency situation wherein the slidable door wing parts are at least in part adjacent or next to each other and wherein the edges of the slidable door wing parts are distant from the sliding door to provide a free and unobstructed passage way through the entrance or the exit, respectively.

* * * * *